US010704546B2

(12) United States Patent
Jackson

(10) Patent No.: US 10,704,546 B2
(45) Date of Patent: Jul. 7, 2020

(54) SERVICE MODULE FOR TROUBLESHOOTING PUMPING UNIT

(71) Applicant: Edward William Jackson, Spirit River (CA)

(72) Inventor: Edward William Jackson, Spirit River (CA)

( * ) Notice: Subject to any disclaimer, the term of this patent is extended or adjusted under 35 U.S.C. 154(b) by 210 days.

(21) Appl. No.: 15/995,784

(22) Filed: Jun. 1, 2018

(65) Prior Publication Data

US 2018/0347559 A1 Dec. 6, 2018

Related U.S. Application Data

(60) Provisional application No. 62/513,660, filed on Jun. 1, 2017.

(51) Int. Cl.

| | |
|---|---|
| ***F04B 51/00*** | (2006.01) |
| ***F04B 49/06*** | (2006.01) |
| ***F04B 49/10*** | (2006.01) |
| ***F04B 47/02*** | (2006.01) |
| ***F04B 43/00*** | (2006.01) |
| ***F04B 49/02*** | (2006.01) |

(52) U.S. Cl.

CPC ..... *F04B 51/00* (2013.01); *F04B 43/0081* (2013.01); *F04B 47/022* (2013.01); *F04B 49/02* (2013.01); *F04B 49/06* (2013.01); *F04B 49/065* (2013.01); *F04B 49/10* (2013.01); *F04B 2205/05* (2013.01); *F04B 2207/703* (2013.01)

(58) Field of Classification Search

CPC ..... F04B 49/022; F04B 49/08; F04B 49/10; F04B 49/02; F04B 51/00; F04B 17/03; F04B 2207/703; F04B 43/0081; F04B 47/022; F04B 49/04; F04B 49/065

See application file for complete search history.

(56) References Cited

U.S. PATENT DOCUMENTS

| | | | | |
|---|---|---|---|---|
| 4,744,729 | A * | 5/1988 | Hasten | G05D 9/12 417/12 |
| 2007/0177985 | A1* | 8/2007 | Walls | F04B 49/10 417/44.2 |
| 2012/0039723 | A1* | 2/2012 | Gresham | F04B 49/022 417/44.2 |
| 2015/0068624 | A1* | 3/2015 | Al-Shammary | F04B 49/022 137/565.13 |

(Continued)

*Primary Examiner* — Dominick L Plakkoottam

(74) *Attorney, Agent, or Firm* — Ryan W. Dupuis; Ade & Company Inc.; Kyle R. Satterthweiste

(57) ABSTRACT

A service module for troubleshooting a pumping unit, particularly that used in the oil/gas industry, is operatively coupled between a motor of the pumping unit and a high pressure shutoff sensor which acts to kill the motor of the pumping unit in the event a pressure of the pipeline exceeds a prescribed threshold. The service module is operable in a first normal operating mode in which the shutoff sensor acts as it normally would to shut off the motor when the prescribed threshold is exceeded, and in a second troubleshooting mode where the normal operation of the shutoff sensor is bypassed for a predetermined period of time. After the predetermined period of time of the second troubleshooting mode has elapsed, the service module automatically returns to the normal operating mode. The shutoff sensor thus remains operatively coupled to the motor during troubleshooting of the motor.

13 Claims, 4 Drawing Sheets

(56) References Cited

U.S. PATENT DOCUMENTS

| | | | | |
|---|---|---|---|---|
| 2015/0139816 | A1* | 5/2015 | Roberts | F04B 17/03<br>417/44.2 |
| 2017/0218944 | A1* | 8/2017 | Schmidt | F04D 25/068 |
| 2018/0128265 | A1* | 5/2018 | Cole | F04B 49/02 |

* cited by examiner

PRIOR ART

SERVICE MODULE FOR TROUBLESHOOTING PUMPING UNIT

This application claims the benefit under 35 U.S.C. 119(e) of U.S. provisional application Ser. No. 62/513,660, filed Jun. 1, 2017.

FIELD OF THE INVENTION

The present invention relates to the oil and gas industry, and more specifically to apparatus for troubleshooting a pumping unit.

BACKGROUND

In at least one example application in the oil and gas industry, pumping units are used to draw crude oil from beneath the ground surface towards the surface for further transport via a pipeline to another location, such as an oil refinery. These pumping units are typically coupled to high pressure shutoff sensors, conventionally which are pressure switches often referred to in industry as Presco pressure switches or Presco for short. This type of shutoff sensor kills a motor of the pumping unit should the pressure on the pipeline exceed a prescribed threshold, thereby avoiding a failure on the pipeline such as a leak or rupture. Pumping units may also be found at spaced distances along the pipeline serving as booster stations for maintaining pressure along the pipeline. These may also be operatively coupled to Fresco's, so as to ensure longevity and safety with respect to the pipeline. More particularly, Oil-Well Pump-Jacks often are powered by single-cylinder engines, such as the Model C66 from Arrow Engines, most often fueled by propane or natural gas. They are typically wired as shown in FIG. 1 below, so as to be wired to shut-down in case the engine loses oil pressure, or the engine loses coolant, or if there is too much pressure in the pipeline that the pump-jack is pumping into.

If an engine does shut down, it is the responsibility of an oil-field operator to repair the problem and restart the engine. Usually the operator arrives on-site without any knowledge about what caused the shut-down. Traditionally, when troubleshooting a pumping unit so as to ascertain the cause for its shutdown, the Presco, which is connected by wires to the motor of the pumping unit, is disconnected from the motor so as to not prevent it from starting. By disconnecting the Presco, the motor is able to start in the event that the Presco is active and would otherwise continue to maintain the motor in a shut-down state. As such, a service technician may continue the diagnostic operation of the motor to determine if an issue localized to the motor of the pumping unit caused it to shutdown. During trouble-shooting of the problem, the operator thus unplugs the safety shut-downs to see which one caused the fault. For example, the motor may have shut down due to an ignition problem, overheating or insufficient oil pressure.

After the diagnostic operation has been completed, the service technician should reconnect the Presco to the motor so that this shutoff sensor remains operable to prevent failure of the pipeline should the pressure exceed a safe acceptable threshold. However, there remains the possibility that the technician forgets to do this, such that the Presco is not reconnected. If the operator forgets to re-connect the safety shut-down, and leaves the engine running, serious damage could occur to the engine or the pipe-line. A pipe-line rupture results in an oil spill, which is an environmental hazard and expensive to clean up.

SUMMARY OF THE INVENTION

The invention seeks to enable servicing of a pumping unit motor while preventing the safety shut-downs from being left unconnected upon completion of servicing.

According to one aspect of the invention there is provided a service module in combination with a motor of a pumping unit operating on a pipeline and a high pressure shutoff sensor for shutting down the motor if pressure on the pipeline exceeds a prescribed threshold;

the motor having an ignition arranged to produce a spark by rotation of a crankshaft of the motor;

the service module being operatively coupled with the high pressure shutoff sensor and the motor such that in a first normal operating mode the high pressure shutoff sensor is enabled to shut down the motor and in a second trouble-shooting mode the high pressure shutoff sensor is prevented from shutting down the motor for a predetermined time interval while remaining operatively coupled to the motor through the service module;

wherein the service module is configured to automatically return to the first normal operating mode after expiry of the predetermined time interval of the second troubleshooting mode.

According to another aspect of the present invention there is provided a service module for use with a motor of a pumping unit operating on a pipeline and a high pressure shutoff sensor for initiating shut down of the motor if pressure in the pipeline exceeds a prescribed threshold, the motor having an ignition arranged to produce a spark by rotation of a crankshaft of the motor, the service module comprising:

an auxiliary switch which is arranged to be operatively coupled with the high pressure shutoff sensor and the motor so as to be operable between a first normal operating mode in which the auxiliary switch enables the high pressure shutoff sensor to shut down the motor and a second trouble-shooting mode in which the auxiliary switch prevents the high pressure shutoff sensor from shutting down the motor while the high pressure shutoff sensor remains operatively coupled to the motor through the service module;

a controller coupled to the auxiliary switch so as to operate the auxiliary switch between the first normal operating mode and the second troubleshooting mode;

the controller defining a prescribed time interval for the auxiliary switch and being arranged to automatically displace the auxiliary switch from the second troubleshooting mode to the first normal operating mode upon expiry of the prescribed time interval subsequent to activation of the auxiliary switch from the first normal operating mode o the second troubleshooting mode.

Thus, the high pressure shutoff sensor, which typically is a pressure switch termed in industry as Presco pressure switch or simply Presco, remains connected to the motor so that a service technician is not required to disconnect the shutoff sensor as part of the typical troubleshooting procedure before restarting the motor. This eliminates the possibility of forgetting to reconnect the shutoff sensor to the motor, which may avert rupture of the pipeline.

When the service module is in combination with the motor, preferably (i) the high pressure shutoff switch comprises a pressure switch arranged to close when sensed pressure in the pipeline exceeds a pressure threshold of the pipeline; (ii) the motor includes a kill wire connected to an electrical ground through the pressure switch in which the motor is configured to cease operation when the kill wire is grounded by the pressure switch; (iii) the auxiliary switch is coupled in series with the pressure switch; (iv) the controller is arranged to close the auxiliary switch in the normal operating mode; and (v) the controller is arranged to open the auxiliary switch in the second troubleshooting mode.

The service module may further comprise an activation switch operatively connected to the controller in which the controller is arranged to displace the auxiliary switch from the first normal operating mode into the second troubleshooting mode for the prescribed time interval upon momentary activation of the activation switch.

The auxiliary switch may comprise a relay switch operated by the controller.

The controller may be operatively connected to an indicator circuit which provides a visual indicator to an operator in response to the high pressure shutoff sensor shutting down the motor.

When the motor includes a secondary shutoff sensor arranged to sense a secondary condition of the motor, the service module may further comprise: (i) a secondary auxiliary switch which is arranged to be operatively coupled in series with the secondary shutoff switch so as to be operable between a first normal operating mode of the secondary auxiliary switch in which the secondary auxiliary switch enables the auxiliary shutoff switch to shut down the motor and a second troubleshooting mode of the secondary auxiliary switch in which the secondary auxiliary switch prevents the secondary shutoff switch from shutting down the motor while the secondary shutoff sensor remains operatively coupled to the motor through the service module; (ii) the controller being coupled to the secondary auxiliary switch so as to operate the secondary auxiliary switch between the first normal operating mode and the second troubleshooting mode thereof; and (iii) the controller defining a prescribed time interval for the secondary auxiliary switch and being arranged to automatically displace the secondary auxiliary switch from the second troubleshooting mode to the first normal operating mode upon expiry of the prescribed time interval subsequent to activation of the secondary auxiliary switch from the first normal operating mode o the second troubleshooting mode.

When provided in combination with the motor, preferably: (i) the secondary shutoff sensor comprises a secondary shutoff switch arranged to close when the sensed secondary condition of the motor exceeds a secondary threshold; (ii) the motor includes a kill wire connected to an electrical ground through the secondary shutoff switch in which the motor is configured to cease operation when the kill wire is grounded by the secondary shutoff switch; (iii) the secondary auxiliary switch is coupled in series with the secondary shutoff switch; (iv) the controller is arranged to close the secondary auxiliary switch in the normal operating mode; and (v) the controller is arranged to open the secondary auxiliary switch in the second troubleshooting mode.

The service module may further comprise a secondary activation switch operatively connected to the controller, the controller being arranged to displace the secondary auxiliary switch from the first normal operating mode into the second troubleshooting mode for the prescribed time interval upon momentary activation of the secondary activation switch.

The secondary auxiliary switch may comprise a relay switch operated by the controller.

The controller may be operatively connected to a secondary indicator circuit which provides a visual indicator to an operator in response to the secondary shutoff sensor shutting down the motor.

The secondary shutoff sensor may comprise an oil pressure sensor arranged to sense a pressure of oil pumped by an oil pump of the motor.

Alternatively, the secondary shutoff sensor comprises a coolant sensor arranged to sense a level of coolant associated with the motor.

It yet further embodiments, there may be provided a plurality of secondary shutoff sensors each arranged to sense a different condition associated with the motor and compare the sensed condition to a respective threshold. In this instance, the service module may comprise a plurality of secondary auxiliary switches operatively connected to respective ones of the secondary shutoff sensors.

The service module may further include an indicator circuit arranged to be operatively connected to a power coil of the ignition of the motor so as to be configured to illuminate when the ignition is receiving power.

The visual indicators may be LEDS. For example, the respective LED of the respective shutoff sensor may illuminate when that sensor is triggering to shut down the motor, and otherwise remain extinguished.

In the illustrated embodiments, the high pressure shutoff sensor is a conventional pressure switch.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
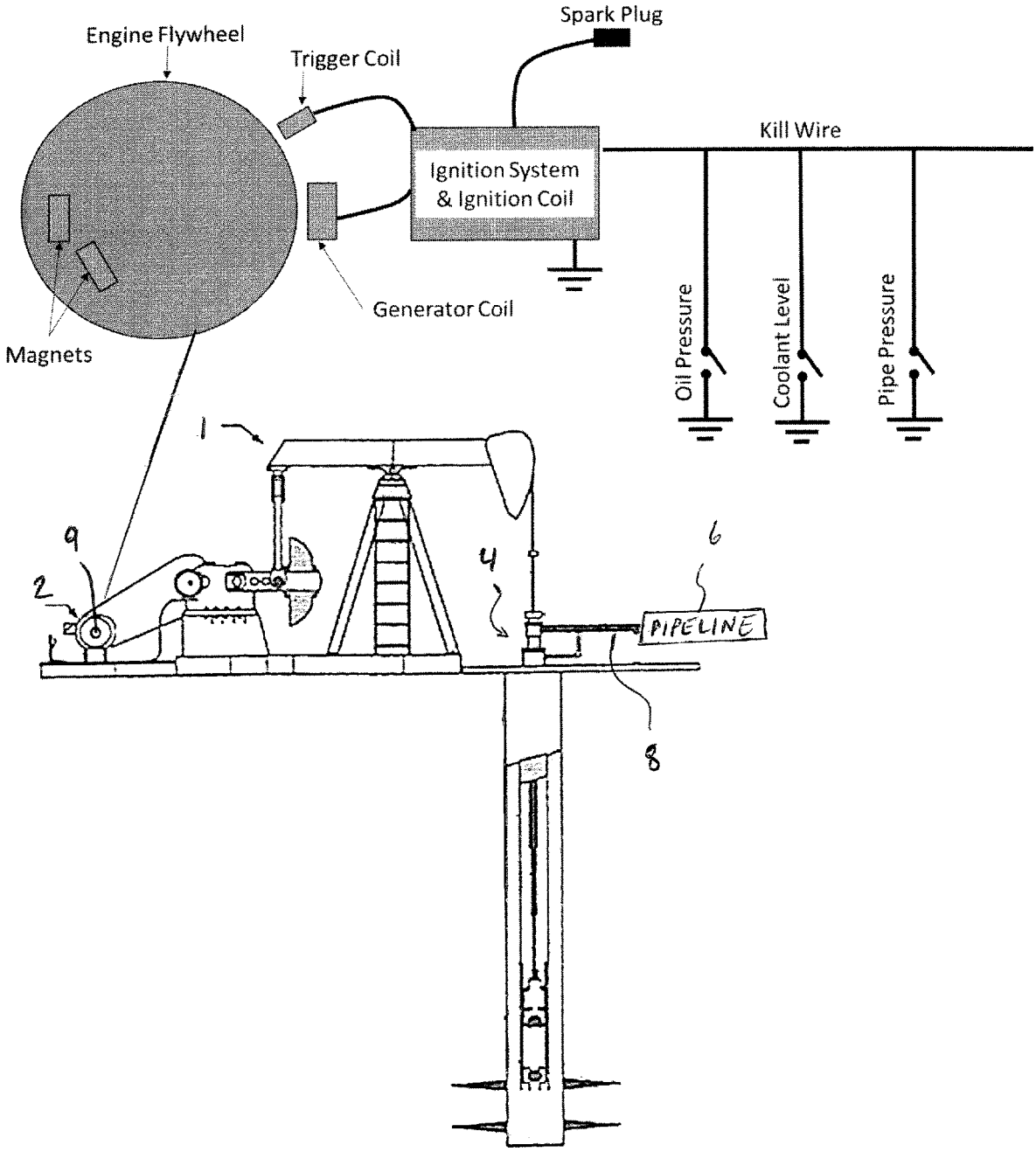
FIG. 1 is a schematic diagram of a prior art configuration of a pumping unit used in the oil and gas industry which includes safety switches to cease operation of the pumping unit in response to certain criteria being met.
Figure 2:
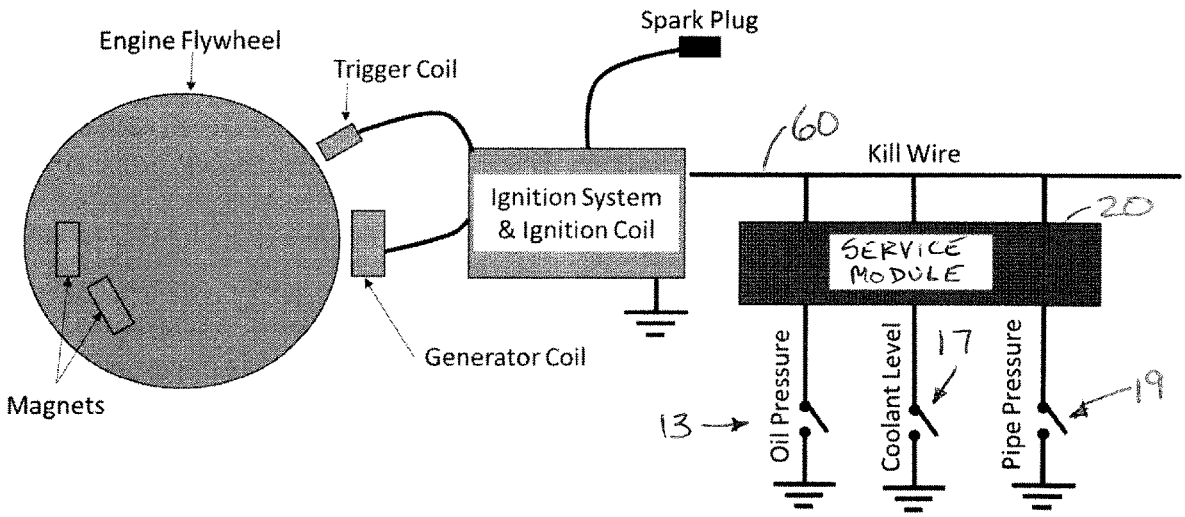
FIG. 2 is a schematic representation of the mounting configuration of the service module according to the present invention in relation to the pumping unit according to FIG. 1.

There is illustrated in the figures a service module 20 for use with a pumping unit 1 which is particularly suited for use in the oil and gas industry. The pumping unit illustrated herein is of the reciprocating pump jack type, but it will be appreciated that other types of pumping units may be used with the service module of the present invention. Each pumping unit 1 includes a motor 2, which may be powered for example by gasoline or diesel fuel, serving as a prime mover of the pumping unit. The remaining components of the pumping unit are not pertinent to the present invention and thus are not described in detail herein, though they will be known to a person skilled in the art.

The pumping unit 1 of the illustrated embodiment operates at a wellhead 4, whereat crude oil is pumped from a location deep beneath the ground surface and is dispensed or delivered therefrom to a pipeline 6 (schematically shown)

which transports the crude oil to another location, such as an oil refinery. The wellhead and any remaining components of the pumping operation are not described in detail herein as they are well known in the art.

The crude oil which has been pumped to the surface is sent from the wellhead 4 through flowlines 8 to the pipeline 6. That is, through the flowlines 8 the wellhead is operatively fluidically connected to the pipeline.

The motor 2 of the pumping unit 1 is typically of the type which has an ignition 8 (schematically shown) arranged to produce a spark by rotation of a crankshaft 9 of the motor. In one example, a type of Magneto alternator (not shown) comprises a pickup coil adjacent a flywheel of the motor, which has located on it at least one magnet. When the flywheel rotates, this magnet passes the pickup coil thereby sending a pulse of power through the Magneto alternator, which is used to create a spark at a spark plug of the ignition.

Typically, the motor includes other systems including a lubrication system 11 (schematically shown) which pumps oil in a closed circuit as typically required of internal combustion motors/motors. Thus there is an oil pump 12 with a motor oil-related shutoff sensor 13 for shutting down the motor if oil level or oil pressure drops beneath a prescribed threshold for the motor to operate properly. For example, the motor-oil related shutoff sensor comprises a Murphy oil gauge with a pressure switch.

Additionally, the motor may have a cooling system 15 (schematically shown) in which coolant is circulating through the motor, with a coolant-related shutoff sensor 17 for shutting down the motor if level of coolant level drops beneath a prescribed threshold for the motor to operate without overheating. For example, the coolant-related shutoff sensor comprises a level sensor within a coolant overflow tank, a pressure sensor to monitor coolant pressure, or a temperature sensor to monitor coolant temperature.

These systems are conventional and are known in the art and thus not described in detail herein.

Furthermore, there is provided a high pressure shutoff sensor 19 such as a Presco pressure switch for shutting down the motor if pressure on the pipeline exceeds a prescribed threshold for the pipeline to avoid rupturing. The high pressure shutoff sensor 19 is operatively coupled to a kill wire 60 of the motor 2 in a manner so as to kill power to the motor when the prescribed pressure threshold on the pipeline is exceeded. Typically this is done by grounding the kill wire of the ignition which sends the spark to the spark plug. When this circuit is grounded, the motor stops turning as the ignition is no longer firing. Conventionally, this grounding connection is provided by wiring which can be disconnected so as to allow the motor to be restarted after an emergency shut down triggered by the Presco.

To kill the motor due to insufficient oil level/pressure or overheating, a conventional connection of the motor oil and coolant related shutoff sensors 13, 17 therefor is provided by grounding wires that ground out the ignition so as to prevent subsequent firing of the ignition such that the motor stops.

However, as opposed to being connected directly to the motor as in the conventional arrangement, the shutoff sensors of the motor and that on the pipeline, i.e., the Presco 19, are connected to the motor 2 through the service module 20 such that the service module can be operated to override the sensors' outputs to shutoff the motor.

Although two embodiments are shown in the accompanying figures, in each instance the service module 20 is operable in a normal operating mode in which each of the high pressure shutoff sensor 19, the motor-oil related shutoff sensor 13, and the coolant-related shutoff sensor 17 is enabled to shut down the motor when activated as they normally would absent the service module. Furthermore, the service module is operable in one or more troubleshooting modes in which each of the foregoing sensors are prevented from shutting down the motor for a predetermined time interval. In other words, in the troubleshooting mode a normal operation of the respective shutoff sensor is bypassed. The service module is configured to automatically return to the first normal operating mode after expiry of the predetermined time interval of the second troubleshooting mode. In either mode of operation of the service module, the aforementioned sensors remain operatively coupled to the motor through the service module and there is no step of disconnecting the sensors from the motor in the troubleshooting process, thereby removing the possibility of inadvertently forgetting to reactivate the sensors by reconnecting corresponding wiring after the motor has been successfully troubleshot and restarted.

Figure 3:
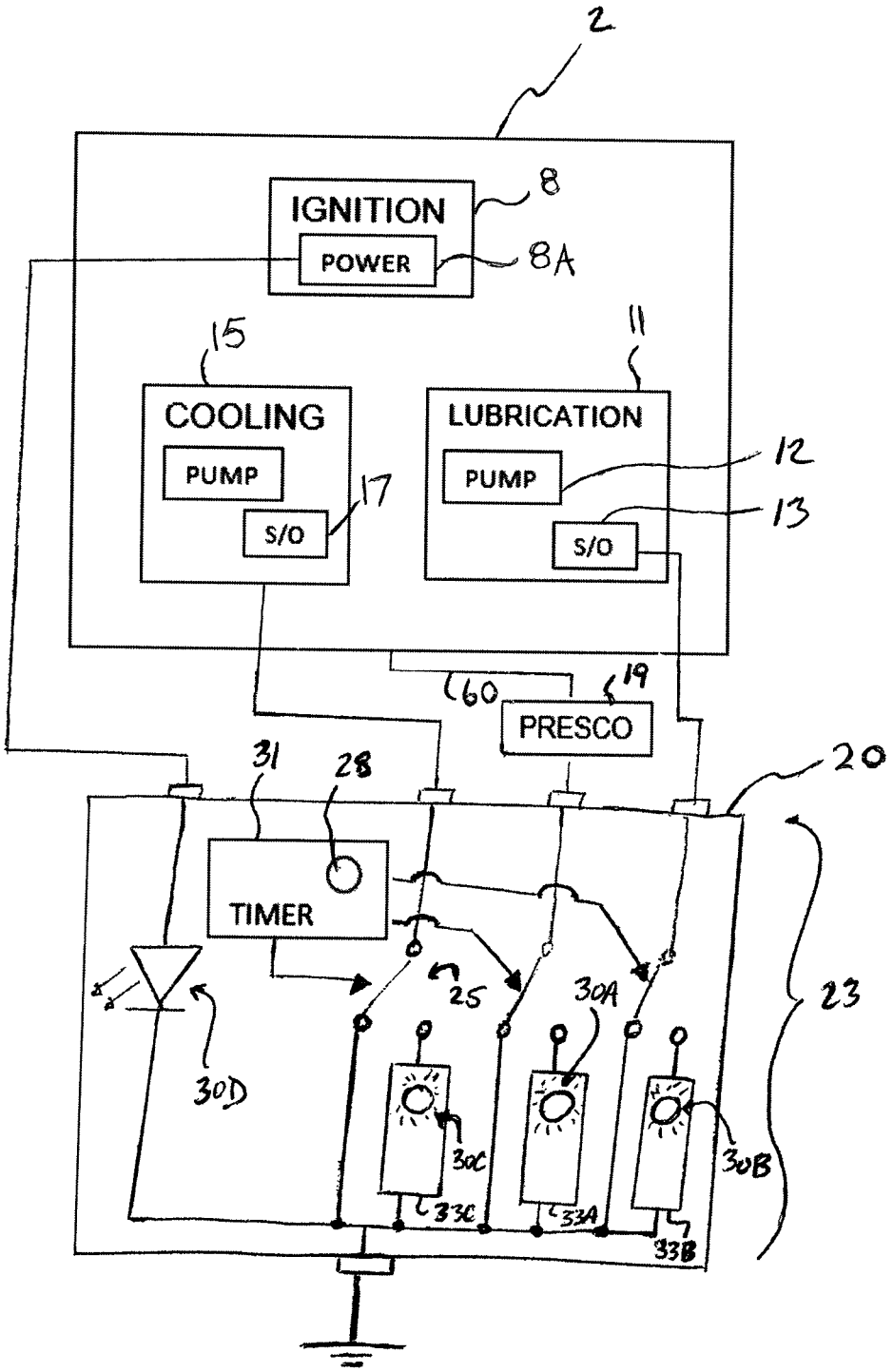
FIG. 3 is a schematic diagram of a first embodiment of the service module according to the present invention when installed upon the pumping unit according to FIG. 1.
Figure 4:
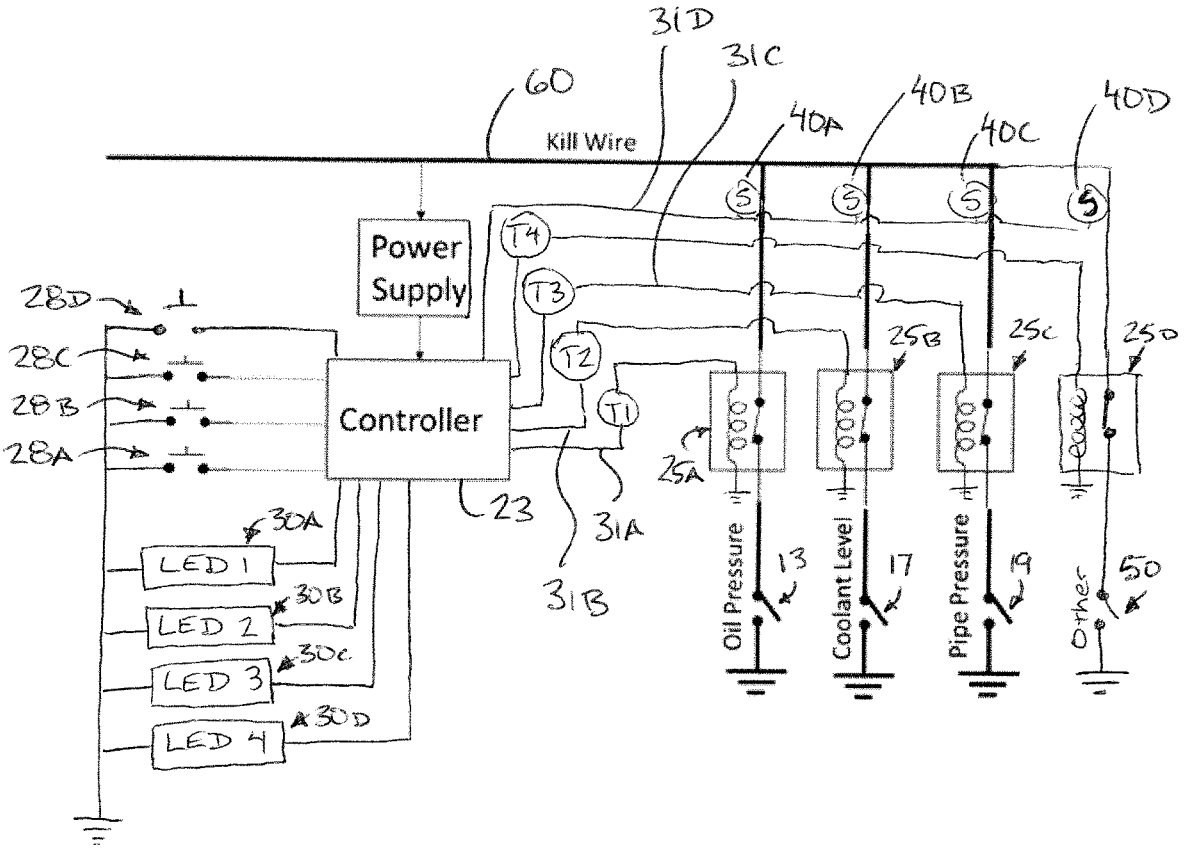
FIG. 4 is a schematic diagram of a second embodiment of the service module according to the present invention when installed upon the pumping unit according to FIG. 1.

As such, the service module 20 comprises a controller defined by an electronic circuit 23 with a series of relay switches 25, or 25A/25B/25C which in a first position, like that illustrated in FIG. 3 or 4, provide the normal operating mode and when positioned in a second position provide the troubleshooting mode described above.

Turning now more particularly to the first embodiment of FIG. 3, the internal electronic circuit 23 is housed in a casing 27 including an actuation button/switch 28 which is depressed in order to commence the troubleshooting mode for the predetermined time interval. The casing 27 also carries a plurality of visual indicators in the form of LEDS 30 each corresponding to one of the high pressure, motor-oil, and coolant related shutoff sensors, and one LED visual indicator which corresponds to ignition power. Each visual indicator 30A through 30C corresponding to a shutoff sensor is configured to illuminate in the troubleshooting mode when the respective shutoff sensor is activated in a manner which would otherwise shut down the motor. As such, in the troubleshooting mode, the normal operation of the respective shutoff sensor is bypassed insofar as it does not cause the motor to shut down; however, the shutoff sensor remains operable to sense those conditions in which it should be triggered, whereby the respective visual indicator is illuminated to help with troubleshooting possible problems with the motor.

Further to the switches 25, the internal circuit 23 includes a timer 31 which is configured to elapse the predetermined time interval, at the expiry of which the switches 25 automatically return to the first position to return operation of each shutoff sensor to its normal operating mode.

In the normal operating mode the circuit 23 with the switches 25 in the first position forms the conventional configuration whereby the motor is shut down. In the troubleshooting mode, the circuit 23 is arranged, for example at 33A-C, so as to prevent the motor from being shut down when the respective shutoff sensor is activated and to illuminate a visual indicator such as LED 30 to signify to the technician that that shutoff sensor has been triggered.

Thus, when a service technician arrives on site of the pumping unit to find the motor not running, the technician operates the service module 20 to commence the troubleshooting mode, after which he proceeds to restart the motor.

For the duration of the predetermined time interval in which the service module remains in the troubleshooting mode, any signals to shut down the motor sent from any one of the shutoff sensors cause the corresponding visual indicator LED 30 to illuminate and do not act to shut down the motor. As the motor therefore is allowed to run at least for the predetermined time interval, this allows the technician to return his attention to the service module 20 to determine which of the shutoff sensors likely caused the initial shutdown of the motor.

Thus, based on an inspection of the service module 20 during the troubleshooting mode the technician can ascertain from the illumination of LEDs where there may be a problem with the pumping unit. If there is no issue with the pumping unit related to the lubrication or cooling system or with the ignition but the pipeline pressure is still higher than the prescribed threshold, the Presco LED 30A will illuminate, thus signifying to the technician that the motor likely does not require service. It is also possible that no LEDs relating to the shutoff sensors illuminate meaning that undesirably high pipeline pressure was the likely cause of the shutdown, but which has now subsided.

However, if one of the LEDs corresponding to either the lubrication system or cooling system 30B, 30C illuminates then the technician thus knows where he may focus his attention in servicing the motor.

Additionally to indicating which of the shutoff sensors 13, 17 or 19 is currently effecting shutdown of the motor, the service module 20 comprises a visual indicator LED 30D which is operatively coupled to a power coil 8A of the ignition so as to be configured to illuminate when the ignition is receiving power. Thus, when the ignition LED 30D does not illuminate this means that the ignition is not receiving power and there thus is likely a problem with the ignition.

The timer 31 can be formed by a capacitive element which is arranged so as to maintain the switches 25 open for the prescribed time interval by discharging its stored energy.

Thus the service module 20 is placed in series with each of the shutoff sensors 13, 17, 19 based on their conventional connection to ground by which the motor is killed when the respective sensor is activated or triggered.

When the technician initially arrives on site of the pumping unit to find the motor dead, it is not clear what the problem which effected the shutdown may have been. As such, in the event that the problem was related to pressure on the pipeline, which the technician cannot readily determine by inspection of components at the site of the pumping unit, he typically acts to disconnect the high pressure shutoff sensor from the motor of the pumping unit to ensure that the motor is not prevented from starting by the Presco and so that he can commence a diagnostic procedure on the motor including restarting same. If coolant level or motor oil level acted to shut down the motor, this is more readily determinable by inspecting the motor by for example checking a corresponding dipstick. If, after restarting the motor, it does not shut down within a reasonable period of time, the technician can conclude that the motor is running properly and that the shutdown was likely effected by the Presco 19. Thus, before leaving the site the technician should proceed to reactivate the high pressure shutoff sensor, which was previously disconnected; however, it is common for technicians to forget this step, which inadvertently puts the pipeline at risk of failing due to surpassing the prescribed threshold pressure.

As such, the service module of the present invention seeks to avoid this problem altogether by providing a configuration in which the high pressure shutoff sensor 19 can remain operatively connected to the motor during a diagnostic procedure/troubleshooting and whose normal operation is selectively bypassed by switching the service module to the troubleshooting mode. The troubleshooting mode remains active only for a predetermined time interval, after which the service module returns operation of the shutoff sensors to their normal mode as if the service module was absent.

It will be appreciated that, generally speaking, the shutoff sensors are triggered when a quantity which the respective sensor is sensing crosses a threshold value, from a tolerable safe range of values to one side of the threshold, to an unacceptable range of value to the other side of the threshold. For the kinds of shutoff sensors previously described, the typical type of crossing of the threshold value, whether falling below and rising above same, has been described, though in other embodiments different properties may be monitored with respect to the temperature or motor oil, for example, thereby resulting in a different direction of crossing of the threshold in order to trigger the shutoff sensor.

Referring now more particularly to the second embodiment shown in FIG. 4, the controller 23 in this instance provides independent actuation of four separate relay switches 25A, 25B, 25C, and 25D which are coupled in series with respective ones of an oil pressure circuit containing the oil pressure switch 13, a coolant circuit containing the coolant level switch 17, a pipeline pressure circuit containing the pipeline pressure switch 19, and an other circuit having a respective other switch 50 therein capable of monitoring another condition of the motor. Each of the relays switches 25A, 25B, 25C, and 25D is normally closed to allow normal operation of the switches 13, 17, 19, and 50 according to the normal mode of operation of the module. Use of normally closed relays ensures that all relays failsafe closed if the power fails, however, some embodiments of the module may use normally open relays if desired. In addition, in further embodiments two or more relays may be used in parallel to provide redundancy within each of the circuits being interrupted. These redundant relays may in turn be controlled by redundant controllers for further redundancy. In the preferred embodiment, the relay switches are electromechanical relays, however in further embodiments transistors or other solid-state type switches may be used.

When actuated by the operator, the controller 23 actuates a respective one of the relay switches 25A, 25B, 25C or 25D to switch the operation of the module into a respective one of three different troubleshooting modes of the module. More particularly, the controller 23 in this instance includes a first actuation switch 28A, a second actuation switch 28B, a third actuation switch 28C, and a fourth actuation switch 28D which can be manually accessed and depressed momentarily by an operator for actuation of the first relay switch 25A, the second relay switch 25B, the third relay switch 25C, or the fourth relay switch 25D respectively. Each of the actuation switches is a momentary contact pushbutton switch in the preferred embodiment. Other embodiments of the invention may use different styles of switches however. The controller 23 also includes a first timer circuit 31 A, a second timer circuit 31B, a third timer circuit 31C, and a fourth timer circuit 31D which serve as the inputs for powering and accordingly actuating the first relay switch 25A, the second relay switch 25B, the third relay switch 25C, and the fourth relay switch 25D respectively. Each timer circuit actuates the respective relay switch to hold the respective relay switch open in an actuated state for a prescribed duration associated with the timer circuit. The prescribed duration begins upon actuation of the respective one of the actuation circuits 28A, 28B, 28C, or 28D. Once the predetermined time has expired, the controller interrupts the signal through the respective timer circuit to allow the respective relay switch to close and cease being actuated. The controller may be further configured such that a further actuation of a respective one of the actuation switches while the prescribed duration has only partially lapsed will cause the timer to be reset so that the corresponding relay switch remains open for the entire prescribed duration following the second actuation.

The controller 23 may draw power by connection to the ignition power circuit 60 which is grounded by the safety switches 13, 17, 19, or 50 when ceasing operation of the pump motor. This ignition power circuit is normally referred to as the kill wire of the ignition system and ignition coil. In further embodiments however, the controller may also draw power directly from the charging coil of the engine ignition, or from an external source such as a solar cell or the battery that is used to start the engine.

Similarly, to the previous embodiment, the controller 23 according to the second embodiment also includes a first indicator circuit 30A, a second indicator circuit 30B, a third indicator circuit 30C, and a fourth indicator circuit 30D which are associated with the oil pressure circuit containing the switch 13, the coolant circuit containing the switch 17, the pipeline circuit containing the switch 19, and the other switch 50 respectively. Each indicator circuit includes a respective LED incorporated therein which is illuminated when the respective switch being monitored has been triggered by the appropriate triggering condition to ground the kill wire. Monitoring of the respective switches may be accomplished using suitable wiring similar to the first embodiment, or in the alternative, suitable current sensors 40A, 40B, 40C or 40D may be operatively associated with the oil pressure circuit containing the switch 13, the coolant circuit containing the switch 17, the pipeline circuit containing the switch 19, or the other switch 50 respectively. Accordingly, in the event that one of the monitored circuits detects a fault resulting in a closing of one of the switches 13, 17, 19 or 50 respectively, the resulted the grounding of the kill wire results in a current passing through the circuit at the location of a respective one of the current sensors 40A, 40B, 40C, and 40D such that the controller 23 detects the current and actuates the corresponding indicator circuit 30A, 30B, 30C or 30D for illuminating the respective LED to serve as an indicator for the operator.

Operation of the second embodiment is similar to the first embodiment. When a fault condition results in one of the switches 13, 17, 19, or 50 being actuated to ground the kill wire and cease operation of the motor, the appropriate LED of the corresponding indicator circuit will be illuminated. An operator arriving at the location will thus be informed of the cause of the fault which resulted in the motor ceasing operation by the illuminated indicator circuit. While attempting to repair the problem, the operator can use the actuation switches 28A through 28D which in turn actuates the corresponding relay switch 25A through 25D for a prescribed duration as dictated by the respective timer circuit 31A through 31D. Once the fault has been corrected, and the operator has left the site, the controller will automatically return the safety switches 13, 17, 19 and 50 back to an operative condition by reverting all of the relays back to the normal mode of operation upon expiry of the respective prescribed durations.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A service module for use with a motor of a pumping unit operating on a pipeline and a high pressure shutoff sensor for initiating shut down of the motor if pressure in the pipeline exceeds a prescribed threshold, the motor having an ignition arranged to produce a spark by rotation of a crankshaft of the motor, the service module comprising:

an auxiliary switch which is arranged to be operatively coupled with the high pressure shutoff sensor and the motor so as to be operable between a first normal operating mode in which the auxiliary switch enables the high pressure shutoff sensor to shut down the motor and a second troubleshooting mode in which the auxiliary switch prevents the high pressure shutoff sensor from shutting down the motor while the high pressure shutoff sensor remains operatively coupled to the motor through the service module;

a controller coupled to the auxiliary switch so as to operate the auxiliary switch between the first normal operating mode and the second troubleshooting mode;

the controller defining a prescribed time interval for the auxiliary switch and being arranged to automatically displace the auxiliary switch from the second troubleshooting mode to the first normal operating mode upon expiry of the prescribed time interval subsequent to activation of the auxiliary switch from the first normal operating mode to the second troubleshooting mode.

2. The service module according to claim 1 in combination with the motor wherein:

the high pressure shutoff switch comprises a pressure switch arranged to close when sensed pressure in the pipeline exceeds a pressure threshold of the pipeline;

the motor includes a kill wire connected to an electrical ground through the pressure switch in which the motor is configured to cease operation when the kill wire is grounded by the pressure switch;

the auxiliary switch is coupled in series with the pressure switch;

the controller is arranged to close the auxiliary switch in the normal operating mode; and the controller is arranged to open the auxiliary switch in the second troubleshooting mode.

3. The service module according to claim 1 further comprising an activation switch operatively connected to the controller, the controller being arranged to displace the auxiliary switch from the first normal operating mode into the second troubleshooting mode for the prescribed time interval upon momentary activation of the activation switch.

4. The service module according to claim 1 wherein the auxiliary switch comprises a relay switch operated by the controller.

5. The service module according to claim 1 wherein the controller is operatively connected to an indicator circuit which provides a visual indicator to an operator in response to the high pressure shutoff sensor shutting down the motor.

6. The service module according to claim 1 for use with a motor including a secondary shutoff sensor arranged to sense a secondary condition of the motor, the service module further comprising:

a secondary auxiliary switch which is arranged to be operatively coupled in series with the secondary shutoff switch so as to be operable between a first normal operating mode of the secondary auxiliary switch in which the secondary auxiliary switch enables the auxiliary shutoff switch to shut down the motor and a second troubleshooting mode of the secondary auxiliary switch in which the secondary auxiliary switch prevents the secondary shutoff switch from shutting down the motor while the secondary shutoff sensor remains operatively coupled to the motor through the service module;

the controller being coupled to the secondary auxiliary switch so as to operate the secondary auxiliary switch between the first normal operating mode and the second troubleshooting mode thereof; and the controller defining a prescribed time interval for the secondary auxiliary switch and being arranged to automatically displace the secondary auxiliary switch from the second troubleshooting mode to the first normal operating mode upon expiry of the prescribed time interval subsequent to activation of the secondary auxiliary switch from the first normal operating mode to the second troubleshooting mode.

7. The service module according to claim 6 in combination with the motor wherein:

the secondary shutoff sensor comprises a secondary shutoff switch arranged to close when the sensed secondary condition of the motor exceeds a secondary threshold;

the motor includes a kill wire connected to an electrical ground through the secondary shutoff switch in which the motor is configured to cease operation when the kill wire is grounded by the secondary shutoff switch;

the secondary auxiliary switch is coupled in series with the secondary shutoff switch;

the controller is arranged to close the secondary auxiliary switch in the normal operating mode; and the controller is arranged to open the secondary auxiliary switch in the second troubleshooting mode.

8. The service module according to claim 6 further comprising a secondary activation switch operatively connected to the controller, the controller being arranged to displace the secondary auxiliary switch from the first normal operating mode into the second troubleshooting mode for the prescribed time interval upon momentary activation of the secondary activation switch.

9. The service module according to claim 6 wherein the secondary auxiliary switch comprises a relay switch operated by the controller.

10. The service module according to claim 6 wherein the controller is operatively connected to a secondary indicator circuit which provides a visual indicator to an operator in response to the secondary shutoff sensor shutting down the motor.

11. The service module according to claim 6 wherein the secondary shutoff sensor comprise an oil pressure sensor arranged to sense a pressure of oil pumped by an oil pump of the motor.

12. The service module according to claim 6 wherein the secondary shutoff sensor comprises a coolant sensor arranged to sense a level of coolant associated with the motor.

13. The service module according to claim 6 further comprises an indicator circuit arranged to be operatively connected to a power coil of the ignition of the motor so as to be configured to illuminate when the ignition is receiving power.

* * * * *